US011255489B2

(12) United States Patent
Xu et al.

(10) Patent No.: US 11,255,489 B2
(45) Date of Patent: Feb. 22, 2022

(54) LIGHT EMITTING MODULE AND LIGHTING DEVICE USING THE SAME

(71) Applicants: OPPLE LIGHTING CO., LTD., Shanghai (CN); SUZHOU OPPLE LIGHTING CO., LTD., Suzhou (CN)

(72) Inventors: Xiaowei Xu, Shanghai (CN); Hongbo Wang, Shanghai (CN); Xuejun Feng, Shanghai (CN); Feng Li, Shanghai (CN)

(73) Assignees: Opple Lighting Co., Ltd., Shanghai (CN); Suzhou Opple Lighting Co., Ltd., Suzhou (CN)

( * ) Notice: Subject to any disclaimer, the term of this patent is extended or adjusted under 35 U.S.C. 154(b) by 136 days.

(21) Appl. No.: 16/660,912

(22) Filed: Oct. 23, 2019

(65) Prior Publication Data

US 2020/0056746 A1 Feb. 20, 2020

Related U.S. Application Data

(63) Continuation of application No. PCT/CN2018/081620, filed on Apr. 2, 2018.

(30) Foreign Application Priority Data

Apr. 26, 2017 (CN) ..... 201720450697.1

(51) Int. Cl.
*F21K 9/232* (2016.01)
*F21V 19/00* (2006.01)

(52) U.S. Cl.
CPC ..... *F21K 9/232* (2016.08); *F21V 19/001* (2013.01)

(58) Field of Classification Search
CPC ..... F21K 9/232; F21K 9/61; F21V 19/001; F21V 19/0045; F21V 17/164; F21Y 2115/10; F21Y 2107/40; F21Y 2103/10
See application file for complete search history.

(56) References Cited

U.S. PATENT DOCUMENTS

2007/0169962 A1 7/2007 Liang
2018/0087748 A1* 3/2018 Gladden ..... G02B 6/0055

FOREIGN PATENT DOCUMENTS

| | | | |
|---|---|---|---|
| CN | 203082683 | U | 7/2013 |
| CN | 203375222 | U | 1/2014 |
| CN | 204240146 | U | 4/2015 |
| CN | 204829373 | U | 12/2015 |
| CN | 105782904 | A | 7/2016 |
| CN | 207065143 | U | 3/2018 |

OTHER PUBLICATIONS

Machine translation of CN105782904A—Light distribution element and illuminating device—Jul. 20, 2016.*
International Search Report (including English translation) and Written Opinion issued in PCT/CN2018/081620, dated Jun. 14, 2018, 10 pages.

* cited by examiner

*Primary Examiner* — Joseph L Williams
*Assistant Examiner* — Jose M Diaz
(74) *Attorney, Agent, or Firm* — Arch & Lake LLP

(57) ABSTRACT

The disclosure provides a light emitting module and a lighting device using the light emitting module. The light emitting module includes a light source component, and several light guide sheets arranged at a periphery of the light source component, the light source component includes several groups of light source strips vertically arranged, and each group of light source strips is covered with one of the light guide sheets.

20 Claims, 9 Drawing Sheets

LIGHT EMITTING MODULE AND LIGHTING DEVICE USING THE SAME

CROSS-REFERENCE TO RELATED APPLICATIONS

This application is based upon and claims the priority of PCT patent application No. PCT/CN2018/081620 filed on Apr. 2, 2018 which claims the priority of Chinese Patent Application No. 201720450697.1 filed on Apr. 26, 2017, the entire content of all of which is hereby incorporated by reference herein for all purposes.

TECHNICAL FIELD

The present disclosure relates to the field of lighting technologies, and in particular, relates to a light emitting module and a lighting device using the same.

BACKGROUND

A bulb lamp is a new energy-saving lamp. The bulb lamp usually includes a housing, a light emitting module, a heat sink and a bulb-type cover, where the light emitting module is fixed horizontally on the heat sink, and the bulb-type cover is connected with the housing after vertically covering the light emitting module.

SUMMARY

The present disclosure provides a light emitting module, a lighting device and a method of manufacturing a light emitting module.

According to a first aspect, a light emitting module is provided. The light emitting module may include a light source component, and several light guide sheets arranged at a periphery of the light source component, where the light source component may include several groups of light source strips vertically arranged, and each group of light source strips is covered with one of the light guide sheets.

According to a second aspect, a lighting device is provided. The lighting device may include a base module, and a light emitting module that is assembled at one end of the base module, where the light emitting module may include a light source component, and several light guide sheets arranged at a periphery of the light source component, where the light source component may include several groups of light source strips vertically arranged, and each group of light source strips is covered with one of the light guide sheets.

According to a third aspect, a method of manufacturing a light emitting module is provided. The method may include providing a light source component; arranging several light guide sheets at a periphery of the light source component; vertically arranging several groups of light source strips comprised in the light source component; and covering each group of light source strips with one of the light guide sheets.

It is to be understood that both the foregoing general description and the following detailed description are exemplary and explanatory only and are not restrictive of the present disclosure.

BRIEF DESCRIPTION OF THE DRAWINGS

The accompanying drawings illustrated here are provided to assist in understanding the present disclosure further and constitute a part of the present disclosure. Examples of the present disclosure and the description thereto are provided to explain the present disclosure and not to limit the present disclosure. In the drawings.

DETAILED DESCRIPTION

Figure 1:
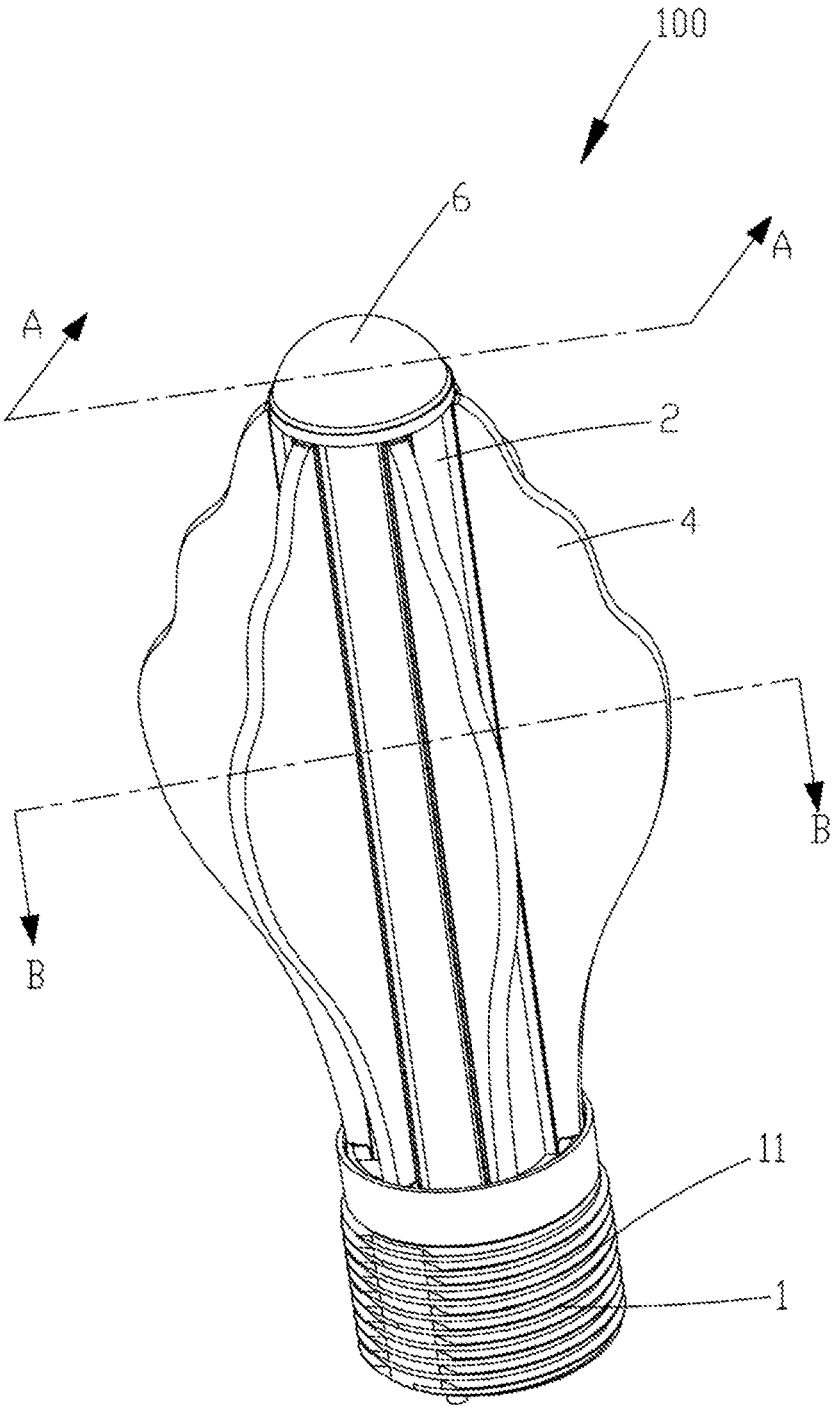
FIG. 1 is a schematic stereo assembly diagram of a lighting device according to examples of the present disclosure.

In order to make objects, technical details and advantages of the examples of the disclosure apparent, the technical solutions of the disclosure will be described in a clearly and fully understandable way in connection with the examples and the drawings related to the examples of the disclosure. It is obvious that the described examples are just a part but not all of the examples of the disclosure. Based on the described examples herein, those skilled in the art can obtain other example(s), without any inventive work, which should be within the scope of the disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Sometimes, since a light emitting angle of a lamp bead is less than 180°, and the light emitting module is arranged horizontally, an illuminating angle of such a bulb lamp may be less than that of the incandescent bulb.

FIGS. 1-9 show a lighting device 100 according to examples of the present disclosure, including a light emitting module, and a base module 1 and a lamp cap 6 assembled at two ends of the light emitting module respectively, wherein the light emitting module includes a pedestal 2, a light source component 3 connected on the pedestal 2, several light guide sheets 4 which are arranged at a periphery of the light source component 3 and are connected with the pedestal 2, and fixing components 5 located at two ends of the light guide sheets 4 and connected with the pedestal 2; the light emitting module emits light at an angle of 360°. Specifically, the light source component 3 includes several groups of light source strips 30 vertically arranged, each of which group is covered thereon with one light guide sheet 4. The above-mentioned lighting device 100 may be applied as an LED lamp for indoor lighting, mounted onto various mounting pedestals (not shown) connected with commercial power, may be used alone or in a combination.

Each element of the lighting device 100 according to examples of the present disclosure and its connection will be explained in detail below.

Figure 2:
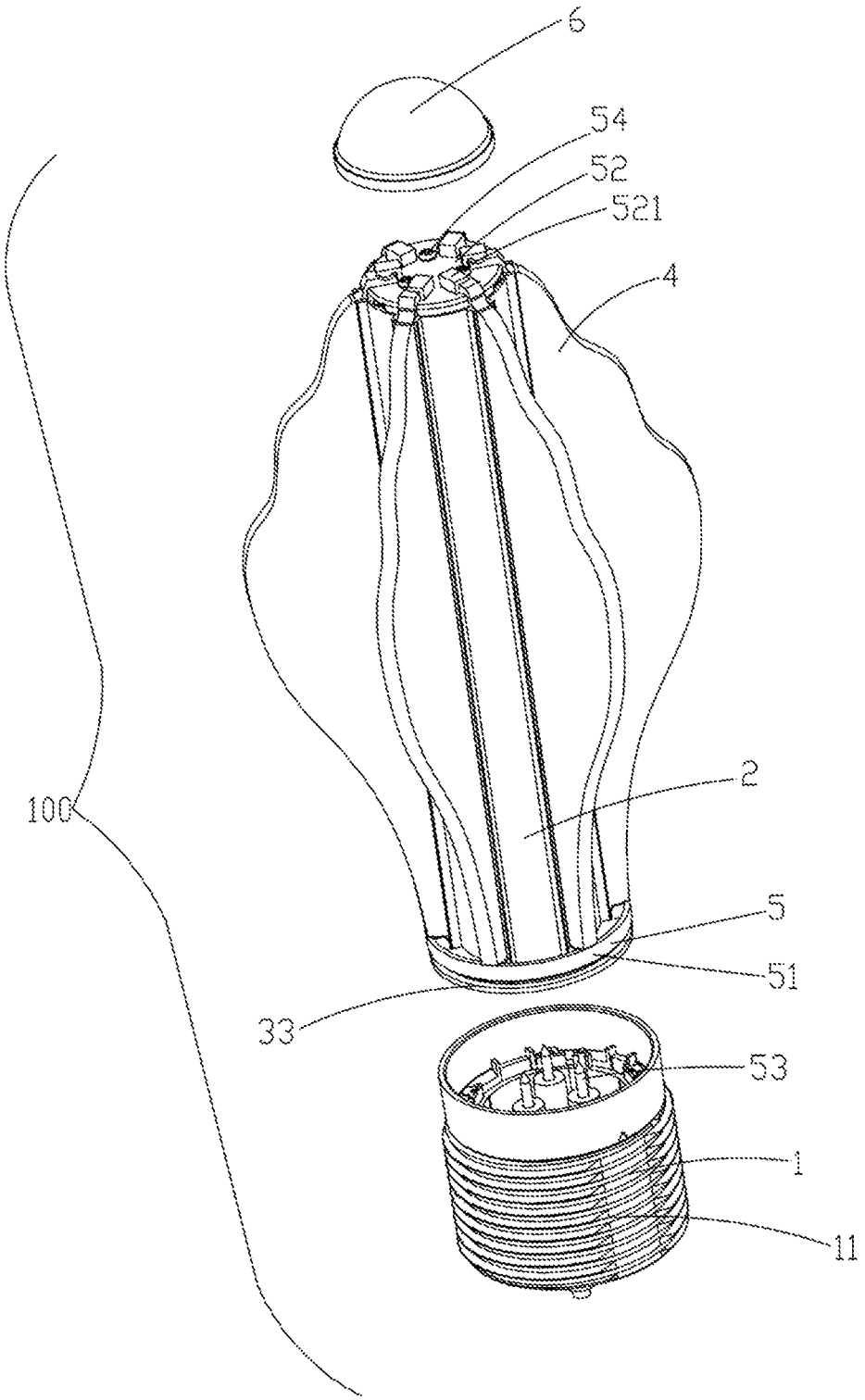
FIG. 2 is a schematic partially exploded diagram of the lighting device shown in FIG. 1.

As shown in FIGS. 1 and 2, the base module 1 includes a housing 11 and several components arranged in the housing 11, including electrical connecting components or physical connecting components, or the like. The electrical connecting component may include a convertor, or the like. In the present example, the base module 1 is connected with a fixing component 5 by means of a first screw 53, and the base module 1 is electrically connected with the light source module 3. In the present example, a driving source module (not shown) is arranged outside the lighting device 100.

Figure 4:
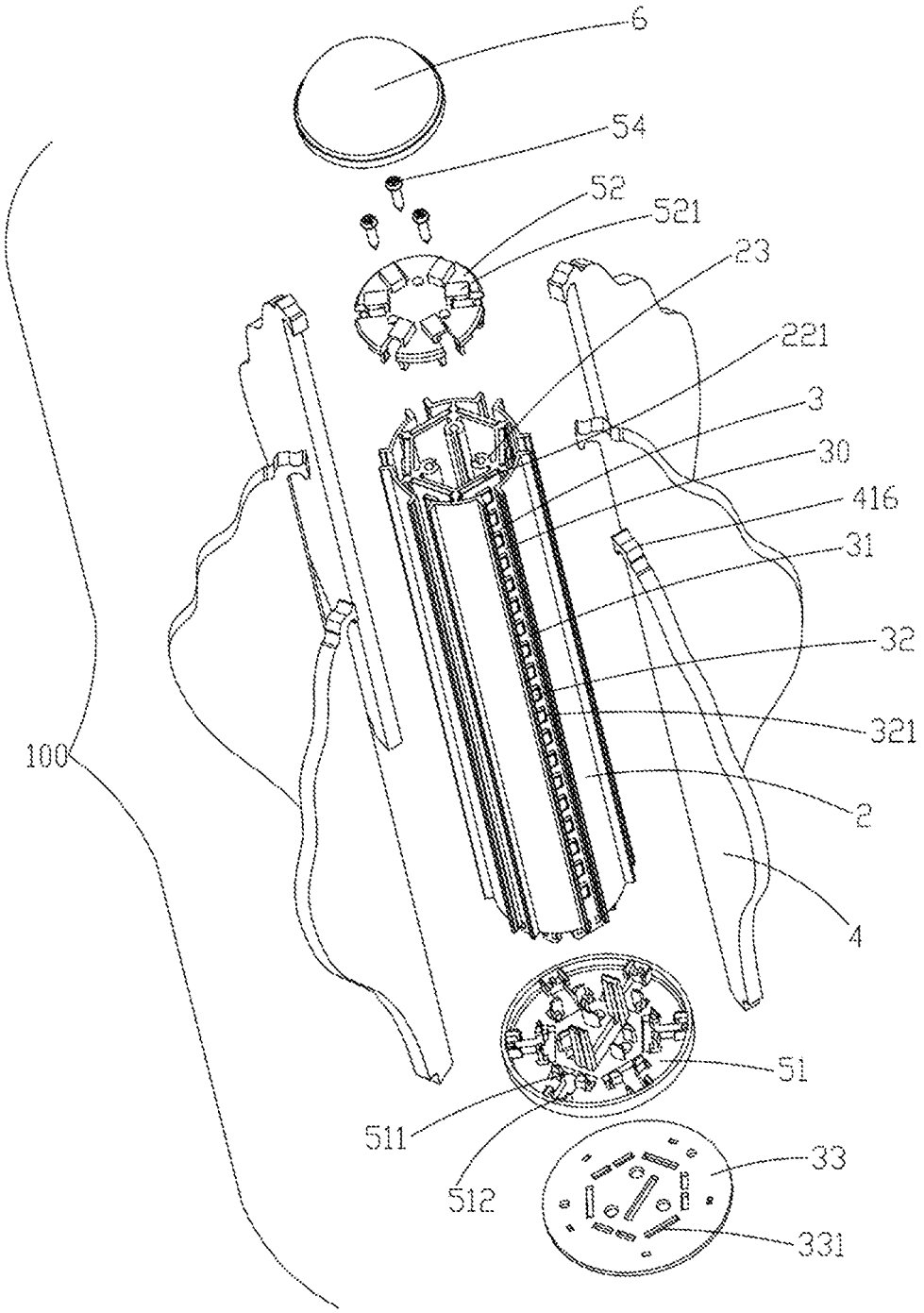
FIG. 4 is a schematic completely exploded diagram of the lighting device shown in FIG. 1.
Figure 6:
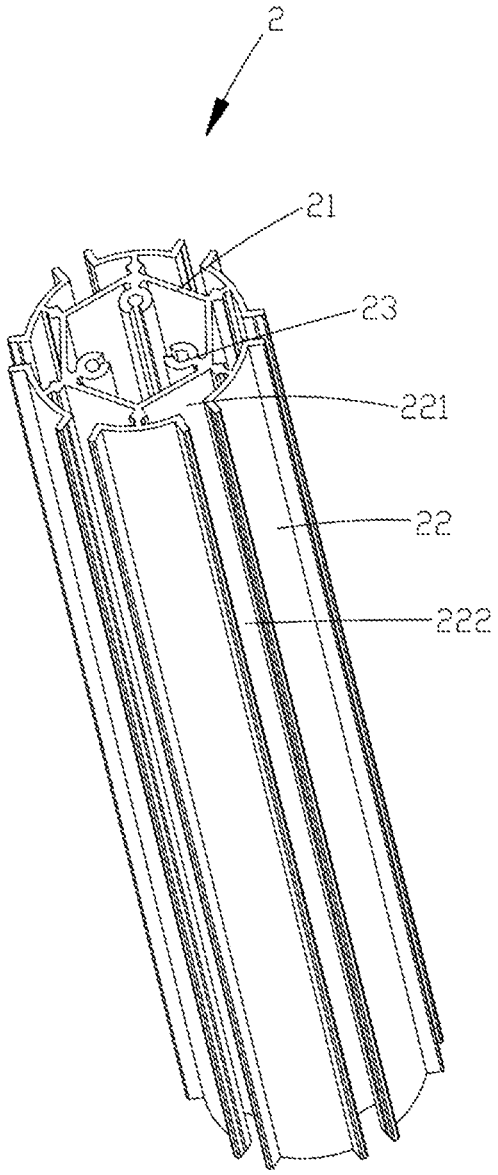
FIG. 6 is a schematic stereo diagram of a heat sink in a lighting device according to examples of the present disclosure.
Figure 7:
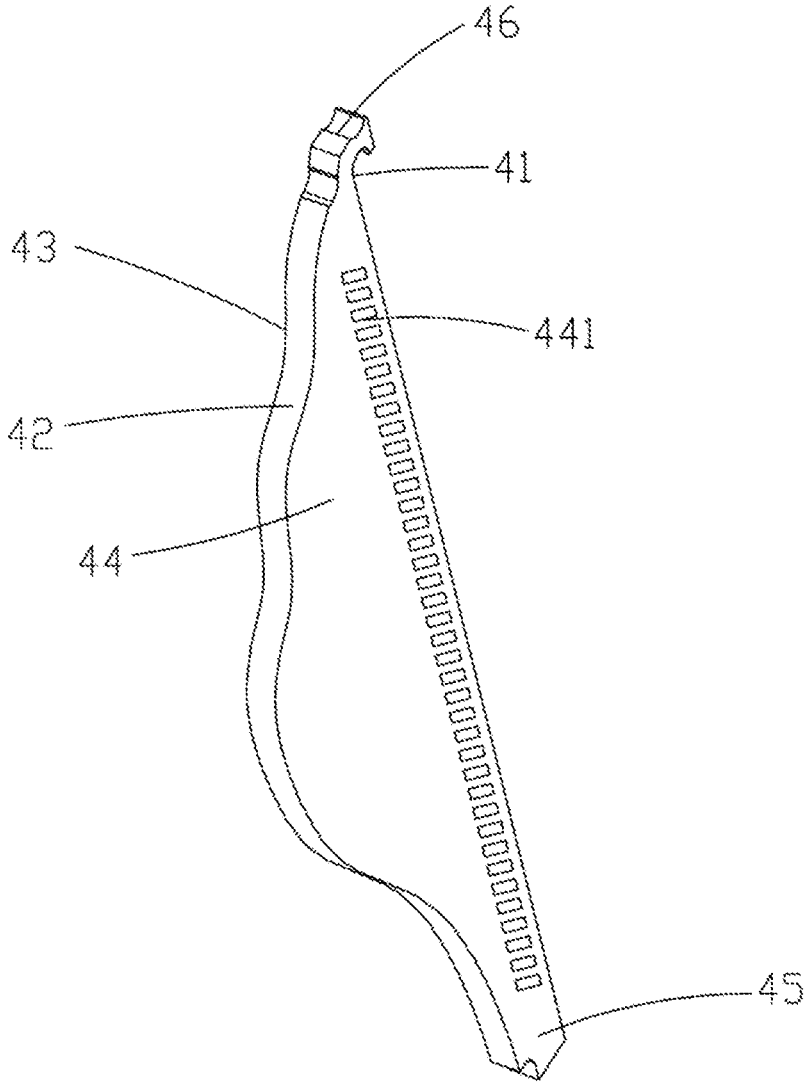
FIG. 7 is a schematic stereo diagram of a light guide sheet in a lighting device according to examples of the present disclosure.

As shown in FIGS. 4 and 6, the pedestal 2 is in a shape of prism, and is an integral structure, preferably made of aluminum. The pedestal 2 is hollow so that provide a heat dissipating function, and may be considered as a heat sink. The pedestal 2 includes an annular side wall 21, several positioning strips 22 protruding outwardly from an external surface of the side wall 21, and several positioning columns 23 protruding inwardly from an inner surface of the side wall 21. The pedestal 2 has a plug-in structure for assembling the light source strips 30 and the light guide sheets 4. Specifically, the several positioning strips 22 are arranged at intervals, and two ends of the positioning strips 22 extend in a vertical direction of the pedestal 2, accommodation grooves 221 for accommodating the light source component 3 and slots 222 for positioning the light guide sheets 4 are formed between adjacent positioning strips 22, and the accommodation grooves 221 and the slots 222 extend in the vertical direction of the pedestal 2. The several positioning columns 23 are arranged at intervals, two ends of the positioning columns 23 extend in the vertical direction of the pedestal 2, and the positioning columns 23 are hollow. In the present example, the side wall 21 is ring-shaped. In other substitutable examples, the side wall 21 may also be of a rectangularly annular shape or other annular shapes.

Figure 5:
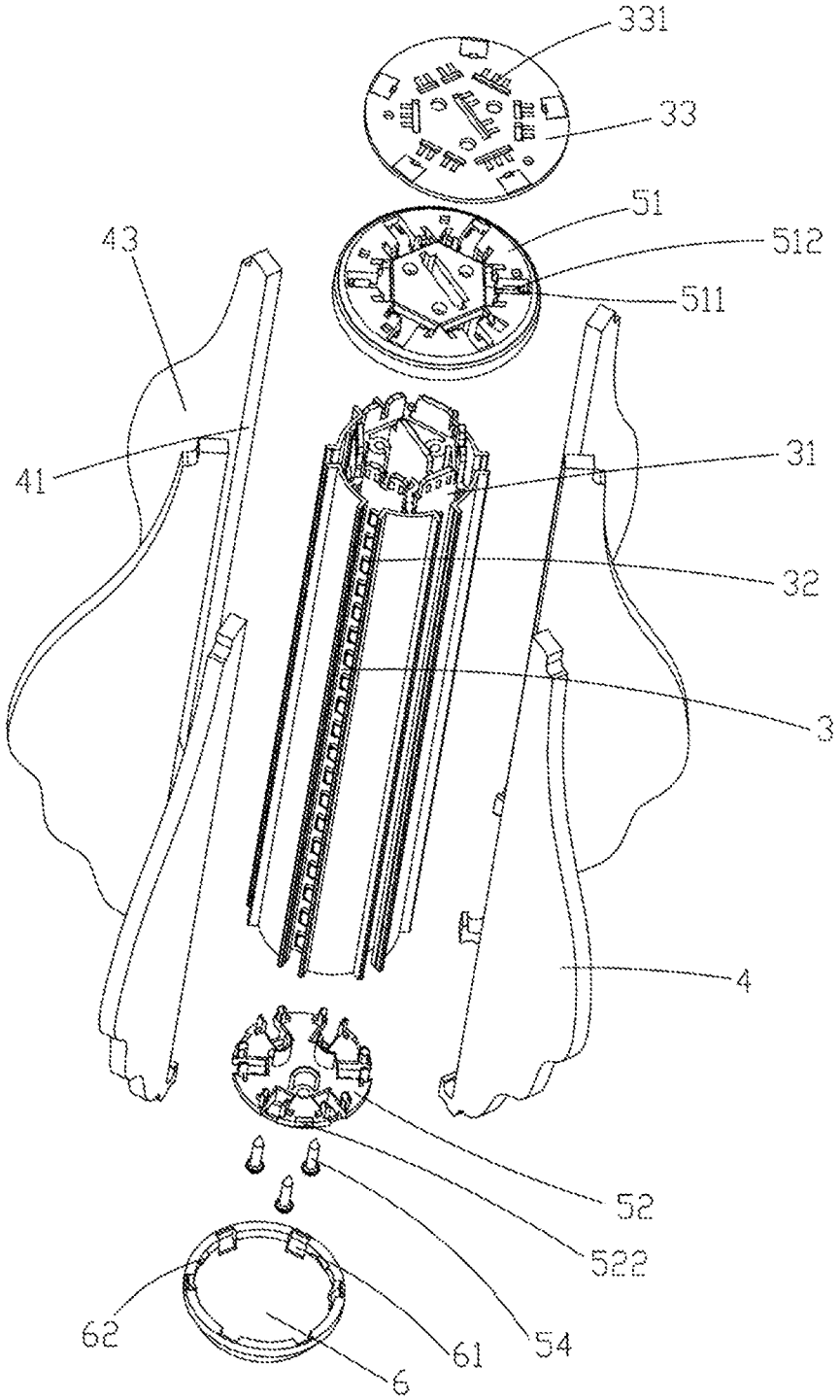
FIG. 5 is a schematic diagram of the lighting device at another angle shown in FIG. 4.
Figure 8:
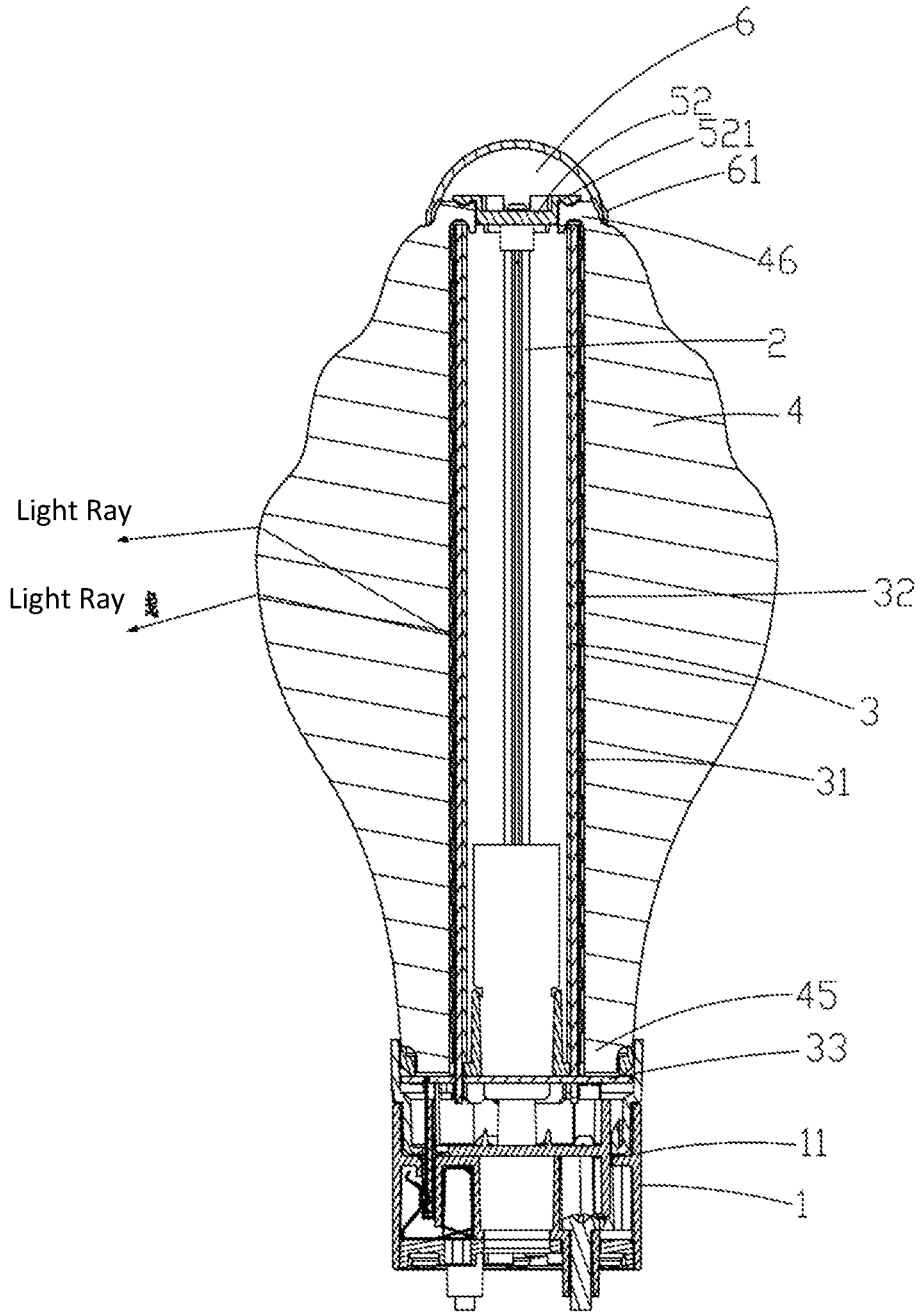
FIG. 8 is a sectional view along A-A line in the lighting device shown in FIG. 1.

As shown in FIGS. 4, 5 and 8, the light source component 3 includes a plurality of groups of light source strips 30 arranged vertically, and light source adapter plates 33 located at tail ends of the light source strips 30 and connected with several light source strips 30. Each group of the light source strip 30 includes a substrate 31, and LED light sources 32 arranged on each of the substrate 31. The substrate 31 is adhered in the accommodation groove 221 of the pedestal 2. The LED light sources 32 include several LED light emitting units 321 arranged vertically. The LED light emitting unit 321 may emit any one of white (W), red (R), blue (B) and green (G) lights. The light source adapter plate 33 is a circular circuit board, on which second through grooves 331 for plugging the substrate 31 in is arranged, and one end of the substrate 31 is plugged in the second through grooves 331, such that several substrates 31 are electrically connected by means of the light source adapter plate 33.

Figure 9:
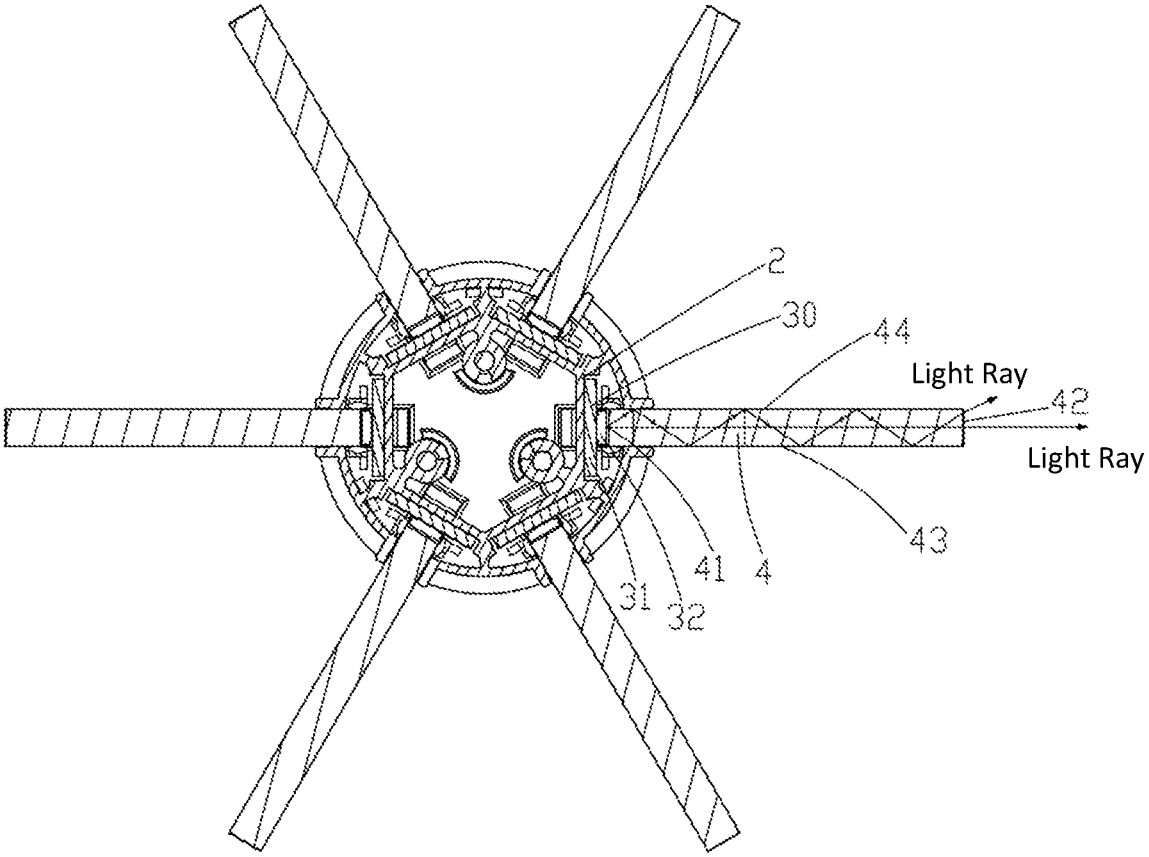
FIG. 9 is a sectional view along B-B line in the lighting device shown in FIG. 1.

As shown in FIGS. 4, 5, 7 to 9, the light guide sheet 4 is made of an insulating material, for example, optical-grade transparent plastic, such as transparent PMMA or transparent PC, or the like, for secondary light distribution to the light rays emitted from the LED light source 32. Each group of light source strip 30 and its corresponding light guide sheet 4 form a light emitting module unit (not shown), and the light emitting module units are distributed uniformly on the light emitting module, such that the light emitting modules are arranged in aggregation to dispersion state from inner to outer side. As shown in FIG. 9, a length of the light guide sheet 4 in a radial direction is greater than a radius of the pedestal 2.

Specifically, the several light guide sheets 4 are arranged vertically and circumferentially. The guide light sheet 4 includes an inner prismatic surface 41 towards the light source strip 30, an outer prismatic surface 42 opposite to the inner prismatic surface 41, first and second side surfaces 43 and 44 connected between the inner prismatic surface 41 and the outer prismatic surface 42, a protrusion portion 45 located at one end of the light guide sheet 4, and a catch 46 located at the other end of the light guide sheet 4. An inner side of the light guide sheet 4 is inserted into the slot 222, and the catch 46 is hooked to the inner side of the side wall 21 of an end of the pedestal 2 towards the cap 6.

Specifically, the inner prismatic surface 41 is a light incident surface of the light guide sheet 4, the outer prismatic surface 42 is a light outgoing surface of the light guide sheet 4, the first and second side surfaces 43 and 44 are two opposite side surfaces of the light guide sheet 4 and are both reflective surfaces, the inner prismatic surface 41 and the first and second side surfaces 43 and 44 are all planes, the outer prismatic surface 42 is an irregular curved surface, and the outer prismatic surface 42 extends to form a light emitting surface which may emit light at least at an angle of 180 degrees. The outer prismatic surface 42 is dull-polished or textured, such that the emitted light rays are uniform and soft, and the lighting effect is improved. The parts of the first and second side surfaces 43 and 44 close to the light source component 3 are dotted by laser or silk screen, the dots 441 by the laser are white printing ink, with a function of diffuse reflection, such that the mixed light between adjacent LED light emitting units 321 is more uniform, and the problem of granular visual effect is alleviated.

The light guide sheets 4 are in one-to-one correspondence to the light source strips 30, each of the light guide surfaces 133 is in a coverage area of an illuminating surface of its corresponding LED light source 32, such that the light rays emitted from the LED light source 32 are coupled to enter the light guide sheet 4, and are all emergent at the outer prismatic surface 42 through internal total reflection. In the present example, a central axis of each of the light guide sheets 4 is on a radiant surface of the central axis of its corresponding LED light source 32. The light emitting surface of the LED light source 32 has a distance of 0.5 mm-1 mm from the inner prismatic surface 41 of the light guide sheet 4, and a width of the inner prismatic surface 41 is greater than that of its corresponding each LED light emitting unit 321, such that more light rays are coupled into the light guide sheet 4. The lighting angle of the lighting device 100 according to the present example is greater than 180°.

As shown in FIGS. 2, 4, 5 and 8, the fixing component 5 includes first and second fixing members 51 and 52 connected at two ends of the pedestal 2, and first and second screws 53 and 54 for connection.

The first fixing member 51 is a circular cover, on a bottom wall of which, a first through groove 511 passing through the substrate 31 and a first slot 512 for positioning the light guide sheet 4 are provided, one end of the substrate 31 passes through the first through groove 511, and is plugged in the second through groove 331, and the protrusion portion 45 of the light guide sheet 4 is accommodated in the first slot 512.

The first screws 53 are located in the base module 1, pass through the light source adapter plate 33 and the first fixing member 51, and then are accommodated in the positioning columns 23, for fixedly connecting the base module 1, the light source adaptor plate 33, the first fixing member 51 and the pedestal 2.

The second fixing member 52 is a circular plate, at an outer end surface of which, several positioning covers 521 are arranged circumferentially, and at an inner end surface of which, several first concave portions 522 are arranged. One end of the substrate 31 is abutted against the inner side of the second fixing member 52, thereby limiting the movement of the light source component 3 up and down. The positioning cover 521 covers the catch 46 of the light guide sheet 4, thereby limiting the movement of the light guide sheet 4 up and down.

The second screws 54 pass through the second fixing member 52, and are then accommodated in the positioning columns 23, for fixedly connecting the light source component 3, the light guide sheet 4, the pedestal 2 and the second fixing member 52.

Figure 3:
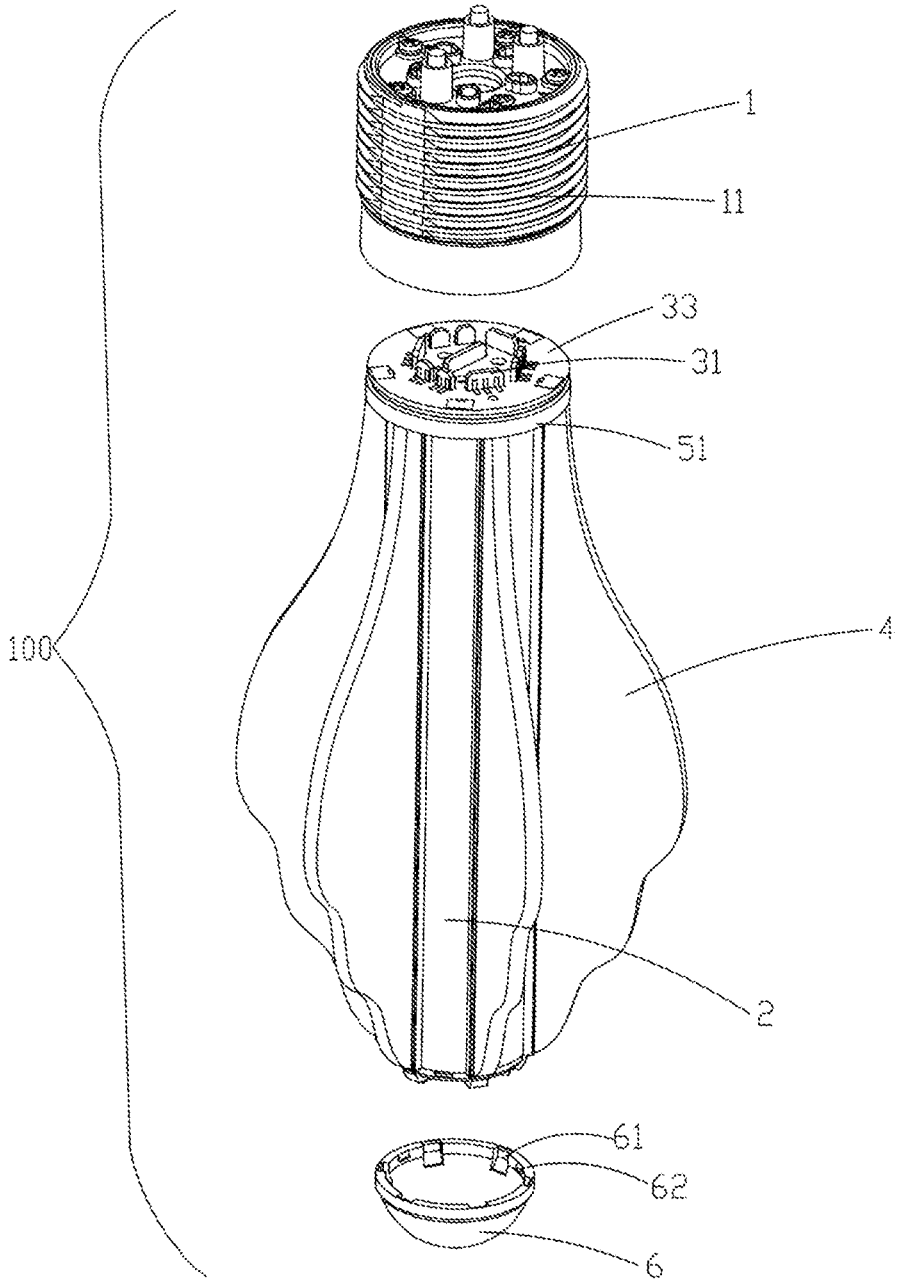
FIG. 3 is a schematic diagram of the lighting device at another angle shown in FIG. 2.

As shown in FIGS. 3 and 8, the lamp cap 6 is in a shape of a dome cover. On an inner surface of the annular end portion thereof, several second concave portions 61 and bumps 62. The lamp cap 6 is snap jointed with the pedestal 2. Specifically, the second concave portions 61 is sleeved on the outer side of the catch 46 of the light guide sheet 4, and the bumps 62 are accommodated in the first concave portions 522 of the second fixing member 52.

To sum up, the lighting device 100 according to the examples of the present disclosure includes several groups of light source strips 30 vertically arranged, and light guide sheets 4 covered at a periphery of each group of light source strip 30. The light guide sheet 4 takes the axial outer prismatic surface as the light outgoing surface, such that the light rays entering the light guide sheet 4 are emergent from the outer prismatic surface 42 of the light guide sheet 4 finally, and thus the lighting device using the light emitting module has a lighting angle greater than 180° with the light emitting effects of a three-dimensional filament.

The present disclosure provides a light emitting module with a relatively large light emitting angle.

In order to realize the above object, the disclosure provides a light emitting module, comprising a light source component, and several light guide sheets arranged at a periphery of the light source component, wherein the light source component comprises several groups of light source strips vertically arranged, and each group of light source strip is covered with one of the light guide sheets.

Further, each group of light source strip and its corresponding light guide sheet form a light emitting module unit, and the light emitting module units are distributed uniformly on the light emitting module.

Further, each group of light source strip and its corresponding light guide sheet form a light emitting module unit, and the light emitting module is arranged in an aggregation to dispersion state from inner to outer side.

Further, the light emitting module emits light at an angle of 360°.

Further, the light emitting module further comprises a pedestal, the pedestal comprising an annular side wall, accommodation grooves and slots are formed to extend vertically on an outer surface of the side wall, the light source strips are located in the accommodation grooves, and inner sides of the light guide sheets are inserted into the slots to cover the light source strips.

Further, the outer surface of the side wall is provided with several positioning strips which protrude outwards and extend vertically, and the accommodation grooves and the slots located at a periphery of the accommodation grooves are formed between adjacent positioning strips.

Further, a length of each of the light guide sheets in a radial direction is greater than a radius of the pedestal.

Further, each of the light source strips comprises a substrate, a LED light source provided on the substrate, the light source component comprises a light source adaptor plate which is located at a tail end of the pedestal and connected with the substrate.

Further, each of the light guide sheets comprises an inner prismatic surface facing the light source strip, an outer prismatic surface opposite to the inner prismatic surface, and a first side surface and a second side surface which are opposite to each other and connected between the inner prismatic surface and the outer prismatic surface, the first and second side surfaces are both total reflection surfaces, and light rays emitted from the light source enter the light guide sheet and then are emergent from the outer prismatic surface.

Further, the outer prismatic surface of the light guide sheet extends to form a light emitting surface which emits light at least at an angle of 180 degrees.

Further, parts of the first and second side surfaces close to the inner prismatic surface are subject to laser dotting or silk screen.

Further, one end of each of the light guide sheets has a catch snap jointed with the pedestal.

Further, the other end of each of the light guide sheet has a protrusion portion.

Further, the light emitting module further comprises a fixing component which includes a first fixing member and a second fixing member, the first and second fixing members are located at two ends of the light guide sheets and connected with the pedestal, for fixing the light guide sheets to the pedestal.

Further, the first fixing member comprises a first through groove and a first slot, each group of light source strip comprises a substrate which passes through the first through groove, and the protrusion portion of each of the light guide sheets is plugged in the first slot.

Further, the second fixing member is provided with several positioning covers for covering the catch.

In order to realize the above objection, the disclosure further provides a lighting device, comprising a base module, and the light emitting module as mentioned above being assembled at one end of the base module.

The advantageous effects are as follows. Compared with other implementations, the light emitting module according to the present disclosure includes a plurality of groups of light source strips arranged vertically and light guide sheets covered at a periphery of each group of light source strip. Light rays emitted from the light source strips are emergent after entering the light guide sheets, such that the lighting device using the light emitting module has a lighting angle greater than 180°.

The present disclosure also provides a method of manufacturing a light emitting module. The method may include providing a light source component; arranging several light guide sheets at a periphery of the light source component; vertically arranging several groups of light source strips comprised in the light source component; and covering each group of light source strips with one of the light guide sheets.

According to the method, each of the light guide sheets may include an inner prismatic surface facing a light source strip, an outer prismatic surface opposite to the inner prismatic surface, and a first side surface and a second side surface which are opposite to each other and connected between the inner prismatic surface and the outer prismatic surface, where the first side and second side surfaces are both total reflection surfaces, and light rays emitted from the light source enter the light guide sheet and then are emergent from the outer prismatic surface.

The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The objects, technical solutions, and advantageous effects of the present disclosure are further described in detail in the foregoing examples. It should be understood that the above descriptions are merely examples of the present disclosure, but not intended to limit the present disclosure. Any modifications, equivalent substitutions and improvements made within the spirit and principle of the present disclosure shall be all included within the scope of the present disclosure.

What is claimed is:

1. A light emitting module, comprising a light source component, and several light guide sheets arranged at a periphery of the light source component, wherein the light source component comprises several groups of light source strips vertically arranged, and each group of light source strips is covered with one of the light guide sheets, wherein the light emitting module further comprises a pedestal, and the pedestal comprises an annular side wall, wherein accommodation grooves and slots are formed to extend vertically on an outer surface of the side wall.

2. The light emitting module according to claim 1, wherein each group of light source strips and its corresponding light guide sheet form a light emitting module unit, and light emitting module units are distributed uniformly on the light emitting module.

3. The light emitting module according to claim 1, wherein each group of light source strips and its corresponding light guide sheet form a light emitting module unit, and the light emitting module is arranged in an aggregation to dispersion state from inner to outer side.

4. The light emitting module according to claim 1, wherein the light emitting module emits light at an angle of 360°.

5. The light emitting module according to claim 1, wherein the light source strips are located in the accommodation grooves, and inner sides of the light guide sheets are inserted into the slots to cover the light source strips.

6. The light emitting module according to claim 5, wherein the outer surface of the side wall is provided with several positioning strips which protrude outwards and extend vertically, and the accommodation grooves and the slots located at a periphery of the accommodation grooves are formed between adjacent positioning strips.

7. The light emitting module according to claim 5, wherein a length of each of the light guide sheets in a radial direction is greater than a radius of the pedestal.

8. The light emitting module according to claim 1, wherein each of the light source strips comprises a substrate, a LED light source is provided on the substrate, and the light source component comprises a light source adaptor plate which is located at a tail end of the pedestal and is connected with the substrate.

9. The light emitting module according to claim 1, wherein each of the light guide sheets comprises an inner prismatic surface facing a light source strip, an outer prismatic surface opposite to the inner prismatic surface, and a first side surface and a second side surface which are opposite to each other and connected between the inner prismatic surface and the outer prismatic surface, wherein the first side and second side surfaces are both total reflection surfaces, and light rays emitted from the light source enter the light guide sheet and then are emergent from the outer prismatic surface.

10. The light emitting module according to claim 9, wherein the outer prismatic surface of the light guide sheet extends to form a light emitting surface which emits light at least at an angle of 180 degrees.

11. The light emitting module according to claim 9, wherein parts of the first side and second side surfaces close to the inner prismatic surface are subject to laser dotting or a silk screen.

12. The light emitting module according to claim 1, wherein one end of each of the light guide sheets has a catch snap jointed with the pedestal.

13. The light emitting module according to claim 12, wherein the other end of each of the light guide sheets has a protrusion portion.

14. The light emitting module according to claim 13, wherein the light emitting module further comprises a fixing component which comprises a first fixing member and a second fixing member, wherein the first and second fixing members are located at two ends of the light guide sheets and are connected with the pedestal for fixing the light guide sheets to the pedestal.

15. The light emitting module according to claim 14, wherein the first fixing member comprises a first through groove and a first slot, each group of light source strips comprises a substrate which passes through the first through groove, and the protrusion portion of each of the light guide sheets is plugged in the first slot.

16. The light emitting module according to claim 15, wherein the second fixing member is provided with several positioning covers for covering the catch.

17. A lighting device, comprising a base module, and a light emitting module that is assembled at one end of the base module, wherein the light emitting module comprises a light source component, and several light guide sheets arranged at a periphery of the light source component, wherein the light source component comprises several groups of light source strips vertically arranged, and each group of light source strips is covered with one of the light guide sheets, wherein the light emitting module further comprises a pedestal, and the pedestal comprises an annular side wall, wherein accommodation grooves and slots are formed to extend vertically on an outer surface of the side wall.

18. The lighting device according to claim 17, wherein the light source strips are located in the accommodation grooves, and inner sides of the light guide sheets are inserted into the slots to cover the light source strips.

19. A method of manufacturing a light emitting module, comprising:

providing a light source component;

arranging several light guide sheets at a periphery of the light source component;

vertically arranging several groups of light source strips comprised in the light source component; and covering each group of light source strips with one of the light guide sheets, wherein the light emitting module further comprises a pedestal, and the pedestal comprises an annular side wall, wherein accommodation grooves and slots are formed to extend vertically on an outer surface of the side wall.

20. The method according to claim 19, wherein each of the light guide sheets comprises an inner prismatic surface facing a light source strip, an outer prismatic surface opposite to the inner prismatic surface, and a first side surface and a second side surface which are opposite to each other and connected between the inner prismatic surface and the outer prismatic surface, wherein the first side and second side surfaces are both total reflection surfaces, and light rays emitted from the light source enter the light guide sheet and then are emergent from the outer prismatic surface.

* * * * *